US009198552B2

(12) United States Patent
Wolfe et al.

(10) Patent No.: US 9,198,552 B2
(45) Date of Patent: Dec. 1, 2015

(54) VACUUM CLEANER WITH SCREEN CAGE

(75) Inventors: Melvin E. Wolfe, Johnson City, NY (US); Randy L. Buss, Muncy, PA (US); Li H. Liu, South Williamsport, PA (US)

(73) Assignee: SHOP VAC CORPORATION, Williamsport, PA (US)

( * ) Notice: Subject to any disclaimer, the term of this patent is extended or adjusted under 35 U.S.C. 154(b) by 611 days.

(21) Appl. No.: 13/454,251

(22) Filed: Apr. 24, 2012

(65) Prior Publication Data

US 2013/0276262 A1 Oct. 24, 2013

(51) Int. Cl.
*A47L 9/12* (2006.01)
*A47L 7/00* (2006.01)

(52) U.S. Cl.
CPC ..... *A47L 7/0071* (2013.01)

(58) Field of Classification Search
USPC ..... 15/347, 327.1, 327.6, 327.7, 352, 353
See application file for complete search history.

(56) References Cited

U.S. PATENT DOCUMENTS

| | | | | |
|---|---|---|---|---|
| 2,029,192 | A | 1/1936 | Ray | |
| 2,722,994 | A | 11/1955 | Fisker | |
| 4,185,974 | A * | 1/1980 | Hiester | 96/406 |
| 4,294,595 | A * | 10/1981 | Bowerman | 96/403 |
| 4,355,434 | A | 10/1982 | Gongwer | |
| 4,868,949 | A | 9/1989 | Loveless et al. | |
| 4,894,881 | A | 1/1990 | Palmer et al. | |
| 4,953,255 | A | 9/1990 | Jenkins | |
| 5,001,807 | A | 3/1991 | Arai | |
| 5,131,114 | A | 7/1992 | Sunagawa et al. | |
| 5,259,087 | A | 11/1993 | Loveless et al. | |
| 5,273,561 | A | 12/1993 | Zeren | |
| 5,704,956 | A | 1/1998 | Loveless et al. | |
| 6,543,085 | B2 * | 4/2003 | Holsten et al. | 15/410 |
| 6,829,804 | B2 * | 12/2004 | Sepke | 15/347 |
| 6,898,821 | B1 | 5/2005 | Bisbee et al. | |
| 7,235,121 | B2 * | 6/2007 | West | 95/273 |
| 8,250,703 | B2 * | 8/2012 | Marshall et al. | 15/352 |
| 2005/0235832 | A1 | 10/2005 | Anderson | |

FOREIGN PATENT DOCUMENTS

| | | | |
|---|---|---|---|
| GB | 2219524 | A | 12/1989 |

* cited by examiner

*Primary Examiner* — Dung Van Nguyen
(74) *Attorney, Agent, or Firm* — Marshall, Gerstein & Borun LLP

(57) ABSTRACT

A vacuum cleaner has a screen cage that is permanently attached to a lid that fits on a receptacle. The screen cage has multiple layers of screens with different screen sizes, including an inner support that has greater rigidity and larger apertures that the primary screen, and an outer screen that also has greater rigidity and larger apertures than the primary screen, and is made of a different material than the support. A replaceable filter mounts to a power head that can be removed from the lid while the lid remains attached to the receptacle, and nests in the screen cage. A thermal cutoff shuts the vacuum cleaner off when the temperature of air in a part of the flowpath exceeds a limit.

15 Claims, 5 Drawing Sheets

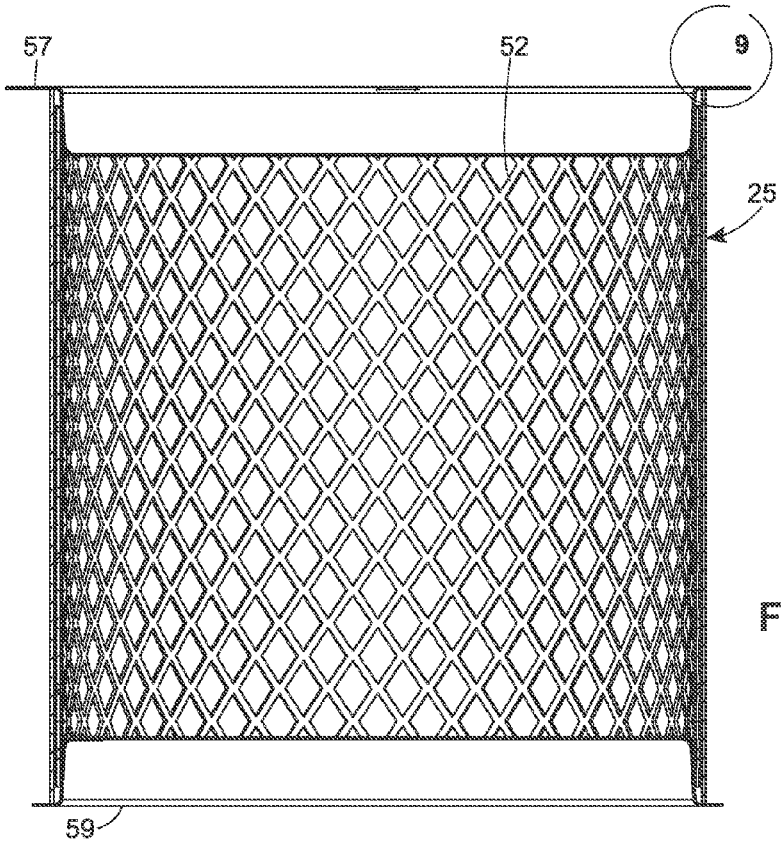
FIG. 6
FIG. 5
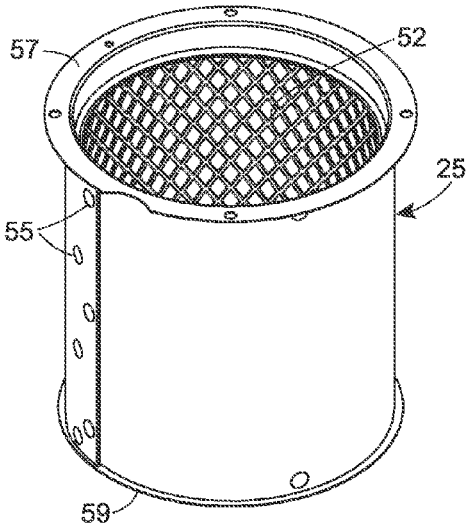
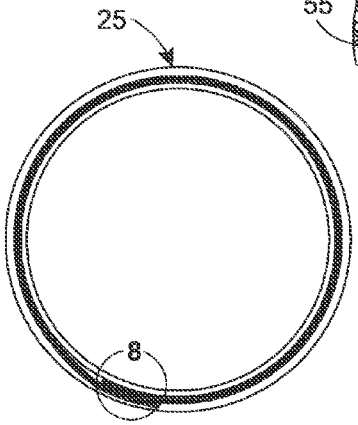
FIG. 7
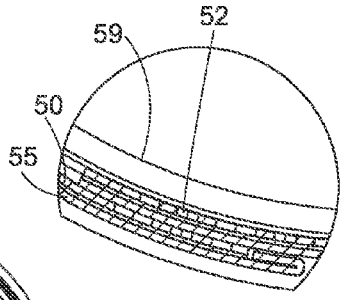
FIG. 8
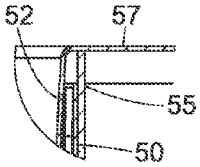
FIG. 9

VACUUM CLEANER WITH SCREEN CAGE

CROSS-REFERENCE TO RELATED APPLICATIONS

Not applicable.

BACKGROUND OF THE INVENTION

The present invention relates generally to vacuum cleaners, and in particular to vacuum cleaners used for picking up fine materials, which may include ash.

BRIEF SUMMARY

The applicants developed a new vacuum for use in vacuuming ashes. It includes a safety feature that was developed to reduce the risk of fire in the event a user uses the device with hot ashes, but may offer pre-filtering advantages in a broad range of vacuum cleaners.

The vacuum cleaner disclosed in U.S. Pat. No. 4,355,434 is designed for use on ashes. The product has a metal screen cage (33) that is wrapped around the filter (30) to protect the filter from sparks/smoldering ashes. The use of expanded metal cages to hold a filter in place is common in the art, with a bolt and wing nut combination that passes through the filter often used to enable the user to remove the screen cage from the lid and simultaneously free the filter for cleaning or replacement.

The new arrangement not only reduces the risk of fire in the event that the product is used to pick up hot ashes, but is also less messy to use and has been found to provide better support and pre-filtering than conventional filter arrangements.

Like prior known vacuum cleaners used for vacuuming ashes, the new vacuum cleaner has a receptacle for debris, a lid that fits on the receptacle, a screen cage that is attached to the lid and extends into the receptacle, and a vacuum source that develops an airflow path that leads into the interior of the receptacle, through the screen cage, to a replaceable filter.

Unlike in previously known vacuum cleaners used for this purpose, the screen cage is permanently attached to the lid, and the replaceable filter is mounted to a power head that can be removed from the lid while the lid remains attached to the receptacle, enabling the filter to be removed and replaced while the lid and screen cage remain attached to the receptacle. The new vacuum cleaner also has a thermal cutoff that shuts the vacuum cleaner off when the temperature of air in a part of the flowpath exceeds a limit.

Unlike previously known screen cages, the new screen cage has multiple layers of screens with different screen sizes. Its primary screen has apertures in the range of 0.05-0.3 mm. It has an inner support that has greater rigidity than the primary screen and has apertures larger than those of the primary screen: in the range of 0.3-2.0 mm. The new screen cage also has an outer screen that is made of a different material than the inner support and has greater rigidity and larger apertures.

BRIEF DESCRIPTION OF THE DRAWINGS

The invention may be better understood by referring to the accompanying drawings, in which:

FIG. 5 is a perspective view of the screen cage from the vacuum cleaner.

FIG. 6 is an enlarged cross-sectional view of the screen cage.

FIG. 7 is a plan view of the screen cage.

FIG. 8 is an enlarged sectional view of a portion of FIG. 7.

FIG. 9 is an enlarged sectional view of a portion of FIG. 6.

DETAILED DESCRIPTION

Figure 1:
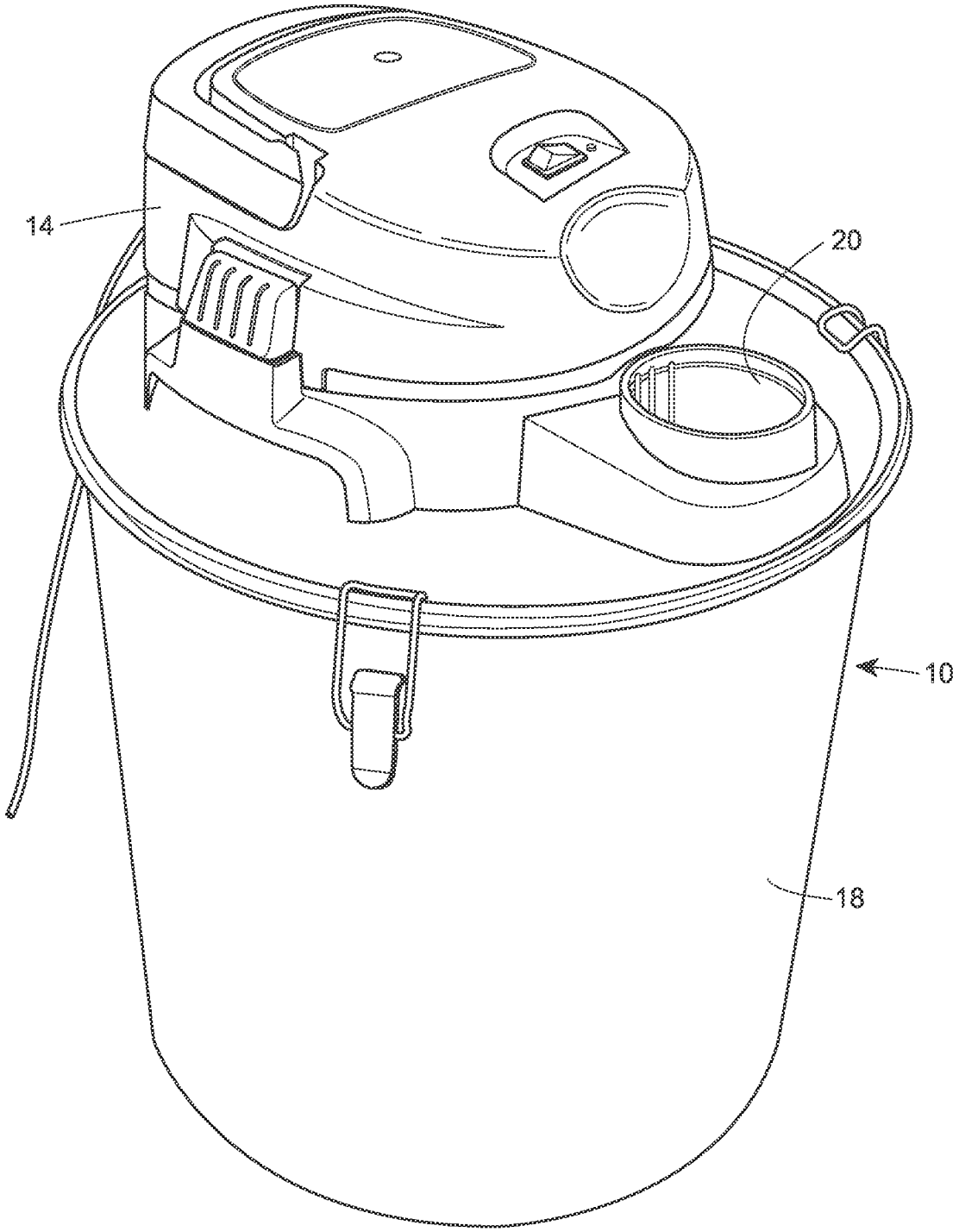
FIG. 1 is a perspective view of one embodiment of a vacuum cleaner that uses the new invention.
Figure 2:
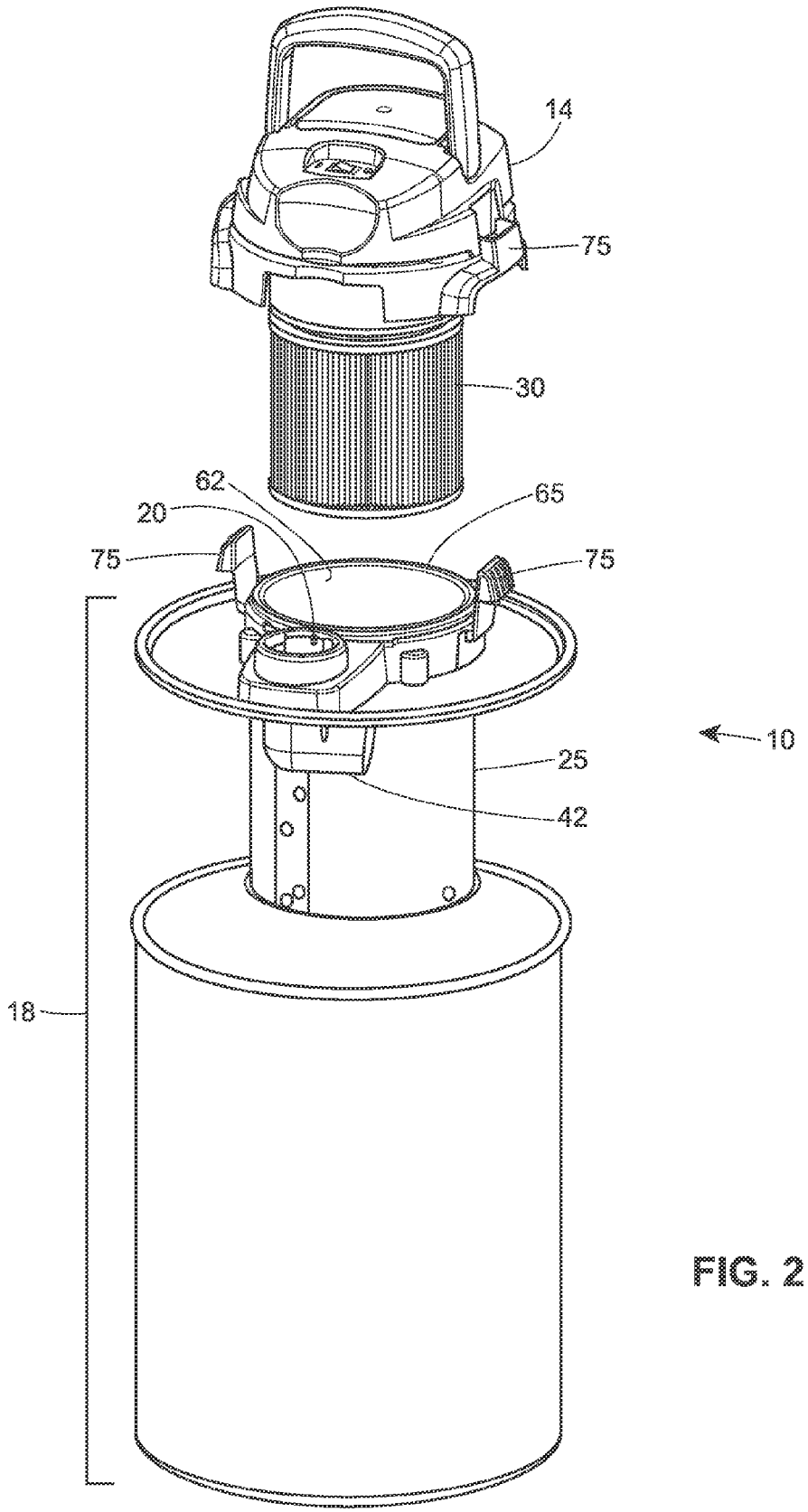
FIG. 2 is an exploded view of a similar vacuum cleaner.
Figure 3:
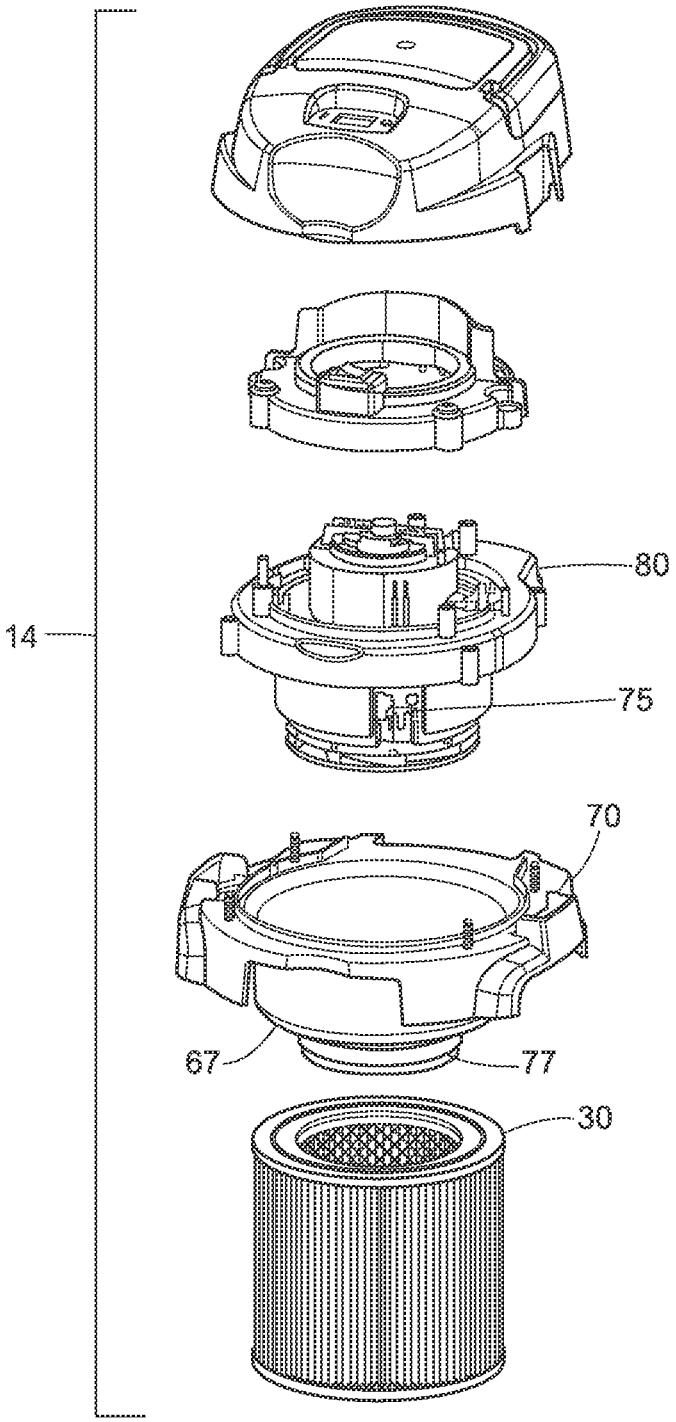
FIG. 3 is an exploded view of the power head of the vacuum cleaner seen in FIG. 2.

As seen in FIGS. 1-3, the new vacuum cleaner 10 has a power head 14 and a receptacle 18. When used, the vacuum cleaner draws air and dirt and debris into the vacuum cleaner though an airflow path that enters the receptacle through an inlet 20, then passes through a screen cage 25 (best seen in FIGS. 2-4, then passes through a replaceable filter 30 (FIGS. 2 and 3), and finally exits through an exhaust on the back of the power head. The replaceable filter 30 provides the primary filtering of the vacuum cleaner 10. The filter can be any type of filter conventionally used in such products, including a HEPA cartridge filter, and in this example, is attached to the power head by a friction fit.

Figure 4:
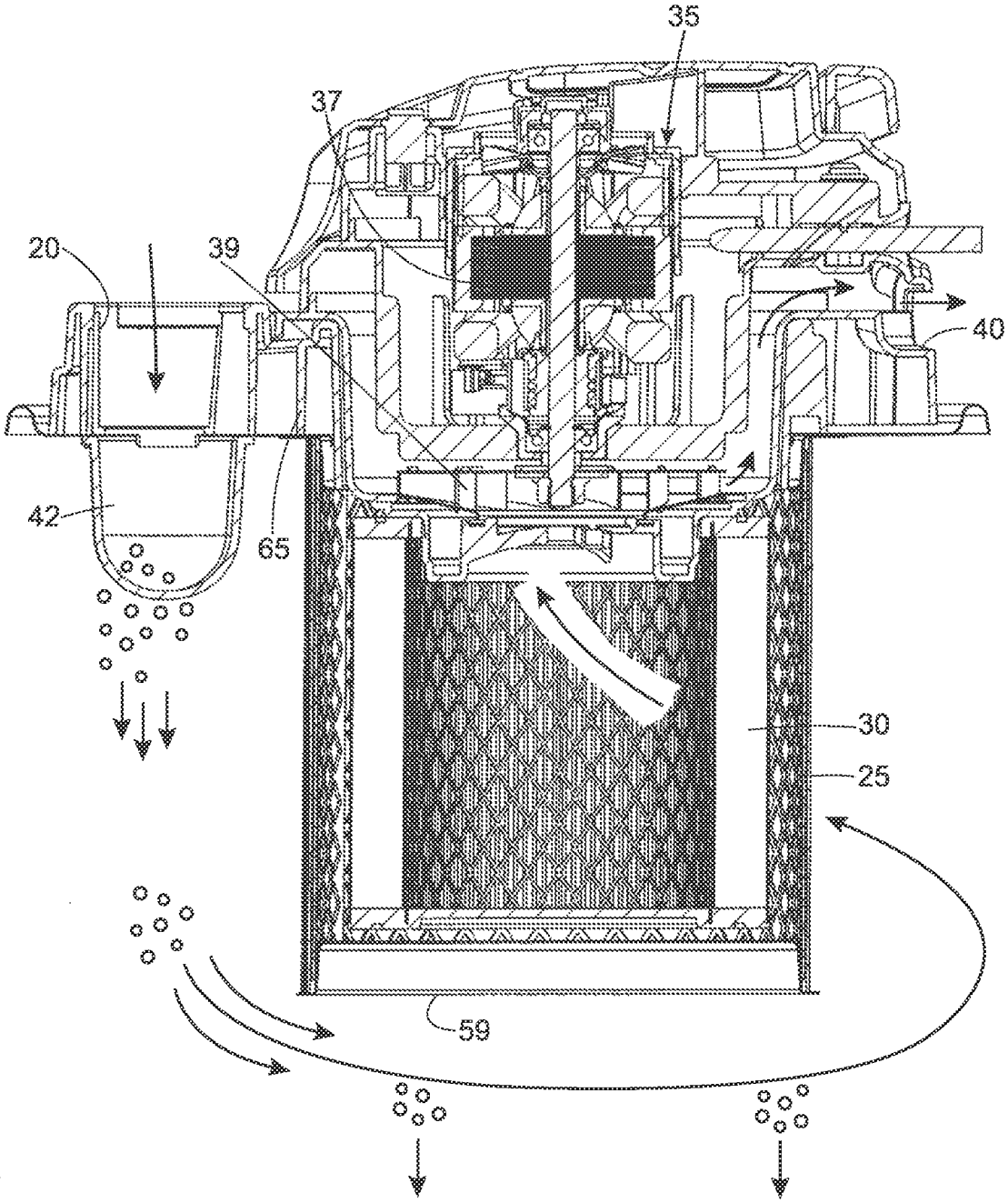
FIG. 4 is a cross-sectional view of the vacuum cleaner.

As seen in FIG. 4, the airflow of the vacuum cleaner is powered by a conventional vacuum source 35 housed in the power head 14. The illustrated vacuum source is an electric motor 37 that drives an impeller 39. The motor can be either battery powered or powered by a cord to an electrical outlet. The illustrated impeller is positioned between the filter 30 and an exhaust 40. Although other impeller positions are possible, positioning the impeller downstream of the filter helps to reduce the chance that dust and debris collected by the vacuum cleaner will damage either the impeller the electric motor.

When the vacuum cleaner is turned on, the vacuum source creates a vacuum that draws dirt-filled air into the receptacle 18 through the inlet 20. An optional deflector 42, preferably made of die cast metal such as aluminum, is mounted adjacent the inlet and directs the incoming airflow to bend 90 degrees and swirl around the perimeter of the receptacle. Dirt and debris falls out of the swirling airflow and collects in the bottom of the receptacle.

The vacuum source 35 draws the rest of the airflow in the receptacle 18 through a screen cage 25 before it reaches the replaceable filter 30. It is preferred that the screen cage be generally cylindrical in shape (as seen in the drawings). As best seen in FIGS. 5-9, the screen cage has a primary screen 50 that provides primary pre-filtering for the replaceable filter 30. Replaceable filters are sometimes made of combustible material, and, when vacuuming ashes, the primary screen helps to reduce the chance of hot or smoldering ash reaching the replaceable filter and creating a fire risk. In other settings, such as when vacuuming drywall (or wallboard) dust, the primary screen can knock solids out of the airflow, helping to preserve the life of the replaceable filter.

It is preferred that the primary screen have apertures in the range of 0.05-0.3 mm. The illustrated primary screen is made of 70×70 mesh of type 304 stainless steel with 0.0065" wire diameter, providing 0.008" openings.

It is also preferred that the screen cage 25 have one or more additional layers of screen made of a different material. One preferred layer, best seen in FIGS. 6 and 9, is a support 52 that has greater rigidity than the primary screen, strengthening the screen cage. The illustrated support is made of 16×16 mesh of galvanized steel with 0.0018" wire diameter, and is provided on the inside surface of the primary screen. Expanded metal could also be used, and may be preferable in some circumstances.

Another preferred layer is an outer screen 55 that has larger apertures than the primary screen 50, providing further pre-filtering of the airflow. Preferably, the outer support has apertures in the range of 0.3-2.0 mm. In the illustrated example, the outer screen is made of the same 16×16 mesh of galvanized steel with 0.0018" wire diameter used for the support. Using the same material for both a support and an outer screen can provide efficiency advantages.

The illustrated screen cage is made by rolling all three layers of screen together into a cylinder that is approximately 6¾" tall and has an outside diameter of approximately 6". The layers are simultaneously joined with a row of spot welds. The cylinder is then attached, such as by spot welding, to an upper ring 57 and to a lower plate 59. The illustrated upper ring and lower plate are made of 0.6 mm thick electro zinc coated deep-drawn quality cold rolled steel, though other materials can also be used. This method of manufacture is particularly useful and efficient.

The assembled screen cage 25 is attached to a lid 60 on the receptacle 18, and preferably extends into the receptacle. In this case, the inlet 20 is on the lid and the lid is itself removable from the rest of the receptacle. However, other arrangements are possible, and it is not essential that the inlet be on the lid or that the lid be separable from the rest of the receptacle.

In some cases, it may be preferred that the screen cage 25 is permanently attached to the lid 60. This can be done, for example, by mechanically fastening the upper ring to the lid, or in any of a variety of conventional ways. In other cases, it may be advantageous to use a screen cage that can be removed from the lid by the owner for cleaning or replacement.

The power head 14 is detachably mounted to the lid 60, covering an aperture 62 in the lid that opens to the interior of the screen cage 25. In this example, a short plastic tank spacer 65 is provided on the lid, ensuring a good fit against a lower rim 67 on a lower housing part 70 of the power head. The replaceable filter 30 extends downwardly from the power head and, when the power head is mounted to the lid, extends through the aperture into the interior of the screen cage, nesting within the screen cage. As seen in FIG. 4, the filter in this example has an outside diameter of approximately 5", leaving a space of approximately ½" between the inside surface of the screen cage and the outside surface of the replaceable filter. The bottom of the illustrated filter lies approximately ¼" inch above the lower plate 59 of the screen cage. This spacing provides good isolation and airflow in the illustrated vacuum cleaner, but can be adjusted in other arrangements.

In the illustrated example, conventional latches 75 (best seen in FIG. 2) are provided near a lower end of the power head 14 and on an upper surface of the lid 60, and are used to secure the power head to the lid. Because the latches are on the upper surface of the lid, they can be accessed by a user without removing the lid from the rest of the receptacle 18, enabling a user to remove the power head (and, with it, the replaceable filter 30). Once the power head is removed, a consumer can remove the filter by pulling it off a mounting hub 77 on the lower housing part 70, and then replace it by pressing a new filter over the hub. Throughout the removal and replacement process, the lid remains attached to the receptacle. Thus, a user can access and replace the filter without the need to remove the screen cage and thus expose the dirt and debris and debris that has been collected in the receptacle. The illustrated latches are bayonet type latches, though other conventional latches can also be used.

In the illustrated vacuum cleaner 10, an automatically resetting thermal cutoff 75 is provided in the flowpath between the impeller 39 and the exhaust 40. This thermal cutoff detects the temperature of air in that part of the airflow path and shuts the vacuum cleaner off when the temperature exceeds a limit. This provides additional fire protection in the event that the vacuum cleaner is used to vacuum hot ash. In this example, the thermal cutoff is mounted on a second plastic housing part 80

This description of various embodiments of the invention has been provided for illustrative purposes. Revisions or modifications may be apparent to those of ordinary skill in the art without departing from the invention. The full scope of the invention is set forth in the following claims.

The invention claimed is:

1. A vacuum cleaner that has:

a receptacle;

a lid that fits on the receptacle;

a power head that is attached to and can be removed from the lid by a consumer while the lid remains attached to the receptacle;

a replaceable filter that mounts to the power head and can be removed and replaced by a consumer while the lid remains attached to the receptacle;

a vacuum source that develops an airflow that leads into the interior of the receptacle, and then to the replaceable filter; and a screen cage that is attached to the lid, and extends into the receptacle, and has apertures that are sized to keep some materials in the airflow from reaching the replaceable filter and are no more than 2.0 mm in size.

2. A vacuum cleaner as recited in claim 1, in which the screen cage is permanently attached to the lid.

3. A vacuum cleaner that has:

a receptacle;

a lid that fits on the receptacle;

a power head that is attached to and can be removed from the lid by a consumer while the lid remains attached to the receptacle;

a replaceable filter that mounts to the power head and can be removed and replaced by a consumer while the lid remains attached to the receptacle;

a vacuum source that develops an airflow that leads into the interior of the receptacle, and then to the replaceable filter; and a screen cage that is attached to the lid, and extends into the receptacle, and has multiple layers of screens with different screen sizes and apertures that are sized to keep some materials in the airflow from reaching the replaceable filter.

4. A vacuum cleaner as recited in claim 3, in which:

the replaceable filter nests in the screen cage when the power head is attached to the lid;

the vacuum cleaner has a thermal cutoff that shuts the vacuum cleaner off when the temperature of air in a part of the flowpath exceeds a limit.

5. A vacuum cleaner as recited in claim 3, in which the screen cage is permanently attached to the lid.

6. A vacuum cleaner as recited in claim 3, in which:

the screen cage has a primary screen;

the screen cage has an outer screen that is positioned on an outer face of the primary screen, has greater rigidity than the primary screen, and has apertures larger than those of the primary screen; and the screen cage has an inner support that is positioned on an inner face of the primary screen, has greater rigidity than the primary screen, has apertures larger than those of the primary screen, and is made of a different material than the outer screen.

7. A vacuum cleaner as recited in claim 3, in which:

the replaceable filter nests in the screen cage when the power head is attached to the lid;

the screen cage has a primary screen;

the screen cage has a support that is positioned on a face of the primary screen and has greater rigidity than the primary screen; and the screen cage has an outer screen that is positioned on an outer face of the primary screen, has greater rigidity than the primary screen, has apertures larger than those of the primary screen, and is made of a different material than the support.

8. A vacuum cleaner as recited in claim in 3, in which the screen cage has apertures that are no more than 2.0 mm in size.

9. A vacuum cleaner as recited in claim 3, in which the vacuum cleaner also has an outer screen that has greater rigidity than another screen, has apertures larger than those of the other screen, and is made of a different material than the support.

10. A vacuum cleaner that has:

a receptacle;

a lid that fits on the receptacle;

a screen cage that is attached to the lid, extends into the receptacle, extends into the receptacle, and has a screen that has apertures in the range of 0.05-0.3 mm;

a support that is part of the screen cage, is positioned on a face of the screen, has greater rigidity than the screen, and has apertures in the range of 0.3-2.0 mm;

a power head that is attached to and can be removed from the lid by a consumer while the lid remains attached to the receptacle;

a replaceable filter that mounts to the power head and can be removed and replaced by a consumer while the lid and the attached screen cage remain attached to the receptacle; and a vacuum source that develops an airflow that leads into the interior of the receptacle, through the screen cage, to the replaceable filter.

11. A vacuum cleaner that has:

a receptacle;

a lid that fits on the receptacle;

a power head that is attached to and can be removed from the lid by a consumer while the lid remains attached to the receptacle;

a replaceable filter that mounts to the power head and can be removed and replaced by a consumer while the lid remains attached to the receptacle;

a vacuum source that develops an airflow that leads into the interior of the receptacle, and then to the replaceable filter;

a screen cage that is attached to the lid, and extends into the receptacle, and has a primary screen with apertures that are sized to keep some materials in the airflow from reaching the replaceable filter;

an outer screen that is positioned on the screen cage, on an outer face of the primary screen, has greater rigidity than the primary screen, and has apertures larger than those of the primary screen; and an inner support that is positioned on an inner face of the primary screen, has greater rigidity than the primary screen, has apertures larger than those of the primary screen, and is made of a different material than the outer screen.

12. A vacuum cleaner as recited in claim 11, in which:

the replaceable filter nests in the screen cage when the power head is attached to the lid.

13. A vacuum cleaner that has:

a receptacle;

a lid that fits on the receptacle;

a screen cage that is attached to the lid, extends into the receptacle, and has multiple layers of screens with different screen sizes;

a power head that is attached to and can be removed from the lid by a consumer while the lid remains attached to the receptacle;

a replaceable filter that mounts to the power head, nests in the screen cage when the power head is attached to the lid, and can be removed and replaced by a consumer while the lid and the attached screen cage remain attached to the receptacle; and a vacuum source that develops an airflow that leads into the interior of the receptacle, through the screen cage, to the replaceable filter.

14. A vacuum cleaner as recited in claim 13, in which:

and the vacuum cleaner has a thermal cutoff that shuts the vacuum cleaner off when the temperature of air in a part of the flowpath exceeds a limit.

15. A vacuum cleaner as recited in claim 13, in which the screen cage has:

a primary screen;

an outer screen that is positioned on an outer face of the primary screen, has greater rigidity than the primary screen, and has apertures larger than those of the primary screen; and an inner support that is positioned on an inner face of the primary screen, has greater rigidity than the primary screen, has apertures larger than those of the primary screen, and is made of a different material than the outer screen.

* * * * *

UNITED STATES PATENT AND TRADEMARK OFFICE

CERTIFICATE OF CORRECTION

PATENT NO. : 9,198,552 B2
APPLICATION NO. : 13/454251
DATED : December 1, 2015
INVENTOR(S) : Melvin E. Wolfe et al.

It is certified that error appears in the above-identified patent and that said Letters Patent is hereby corrected as shown below:

On the Title Page:

At Item (57), line 5, “that the” should be -- than the --.

In the Claims:

At Column 4, line 51, claim 4 “lid;” should be -- lid; and --.

At Column 5, line 13, claim 8 “in 3,” should be -- 3, --.

At Column 6, lines 35-36, claim 14 “and the” should be -- the --.

Signed and Sealed this
Third Day of May, 2016

Michelle K. Lee

Michelle K. Lee
*Director of the United States Patent and Trademark Office*